US005170765A

United States Patent [19]

Hoshino et al.

[11] Patent Number: 5,170,765

[45] Date of Patent: Dec. 15, 1992

[54] CANISTER FOR STORING FUEL

[75] Inventors: Hideki Hoshino; Masatoshi Udagawa; Hideo Watanabe; Koichi Hidano, all of Tochigi, Japan

[73] Assignee: Honda Giken Kogyo Kabushiki Kaisha, Tokyo, Japan

[21] Appl. No.: 843,602

[22] Filed: Feb. 28, 1992

[30] Foreign Application Priority Data

Feb. 28, 1991 [JP] Japan ..... 2-32296

[51] Int. Cl.[5] ..... F02M 33/02

[52] U.S. Cl. ..... 123/520; 123/519

[58] Field of Search ..... 123/516, 518, 519, 520, 123/521; 55/387

[56] References Cited

U.S. PATENT DOCUMENTS

| | | | |
|---|---|---|---|
| 4,203,401 | 5/1980 | Kingsley et al. | 123/520 |
| 4,683,862 | 8/1987 | Fornuto et al. | 123/520 |
| 4,714,485 | 12/1987 | Covert | 55/189 |
| 4,862,856 | 9/1989 | Yokoe et al. | 123/520 |
| 4,887,578 | 12/1989 | Woodcock et al. | 123/519 |
| 4,894,072 | 1/1990 | Turner et al. | 123/519 |
| 4,919,103 | 4/1990 | Ishiguro et al. | 123/519 |
| 4,951,643 | 8/1990 | Sato | 123/520 |
| 4,986,840 | 1/1991 | Mori et al. | 123/519 |
| 5,056,494 | 10/1991 | Kayanuma | 123/519 |

FOREIGN PATENT DOCUMENTS

| | | | |
|---|---|---|---|
| 0029761 | 2/1984 | Japan | 123/520 |
| 62-265460 | 11/1987 | Japan . | |
| 1-159455 | 6/1989 | Japan . | |

*Primary Examiner*—Tony M. Argenbright
*Assistant Examiner*—Thomas N. Moulis
*Attorney, Agent, or Firm*—Armstrong & Kubovcik

[57] ABSTRACT

A fuel storage canister includes a fuel storage chamber defined in a housing and connected to a fuel tank, a first activated carbon layer disposed in said housing for adsorbing fuel vapor, a first passageway connected to said housing for venting said fuel storage chamber through said first activated carbon layer to the atmosphere, a second activated carbon layer disposed in said housing for adsorbing fuel vapor, and a second passageway connected to said housing for venting said fuel storage chamber through said first and second activated carbon layers to the atmosphere. A directional control valve is connected to said first and second passageways for selectively opening said first and second passageways depending on an operating condition of the engine. When the engine is out of operation, requiring a large amount of fuel vapor to be stored in the canister, the fuel storage chamber is vented to the atmosphere through the first and second activated carbon layers by the second passageway for thereby adsorbing the fuel vapor with the first and the second activated carbon layers. When the engine is in operation, the fuel storage chamber is vented to the atmosphere through only the first activated carbon layer by the first passageway for thereby adsorbing the fuel vapor with the first activated carbon layer, with no fuel vapor adsorbed by the second activated carbon layer.

11 Claims, 4 Drawing Sheets

CANISTER FOR STORING FUEL

BACKGROUND OF THE INVENTION

1. Field of the Invention

The present invention relates to a fuel storage canister for use in an engine fuel supply system, and more particularly to a fuel storage canister for preventing fuel from being evaporated into the atmosphere while an engine is not operating.

2. Description of the Relevant Art

U.S. Pat. No. 4,951,643 discloses a closed-bottom fuel storage canister having a fuel storage section in a lower portion of a canister housing and an activated carbon layer above the fuel storage section. The fuel storage section of the disclosed fuel fuel storage canister communicates with the fuel tank of an automobile through a charge pipe, and also with the intake manifold of the engine of the automobile through a purge pipe. The fuel storage section is vented to the atmosphere through the activated carbon layer and a drain outlet defined in an upper portion of the housing.

In the conventional fuel storage canister, while the engine is not operating, a high-boiling-point component of the fuel vapor tends to be adsorbed by the activated carbon layer, which is then saturated. If the engine remains out of operation for a long period of time without the high-boiling-point component being purged, then a low-boiling-point component of the fuel vapor inevitably passes through the activated carbon layer into the atmosphere.

Japanese laid-open patent publication No. 1-159455 published Nov. 18, 1987 shows a canister having a first space section, a first fuel vapor adsorbent, a section space section, a second fuel vapor adsorbent, and a third space section which are successively positioned and defined in a casing. The first space section is connected from an inlet port to the fuel tank of an automobile through a valve that is opened only when fuel is supplied to the fuel tank. The first space section also communicates with the intake manifold of the engine of the automobile from a purge port. The third space section is vented to the atmosphere from an atmosphere port.

According to the above prior canister, the first and second adsorbents are positioned between the first space section connected to the fuel tank and the third space section vented to the atmosphere. Therefore, while the engine is not operating, a high-boiling-point component of the fuel vapor is adsorbed by the first and second adsorbents, which are then saturated. A low-boiling-point component of the fuel vapor is also inevitably caused to pass into the atmosphere while the engine is not operating. Particularly, the first and second adsorbents are liable to suffer aging as they are exposed to the fuel vapor at all times.

SUMMARY OF THE INVENTION

It is an object of the present invention to provide a fuel storage canister for reliably storing fuel vapor when an engine associated with the fuel storage canister is out of operation.

According to the present invention, there is provided a fuel storage canister for use with an engine and a fuel tank, comprising a housing, a fuel storage chamber defined in the housing and adapted to be connected to the fuel tank, a first activated carbon layer disposed in the housing for adsorbing fuel vapor, first passage means connected to the housing for venting the fuel storage chamber through the first activated carbon layer to the atmosphere, a second activated carbon layer disposed in the housing for adsorbing fuel vapor, second passage means connected to the housing for venting the fuel storage chamber through the first and second active carbon layers to the atmosphere, and valve means connected to the first and second passage means for selectively opening the first and second passage means depending on an operating condition of the engine.

When the engine is in operation, the fuel storage chamber is vented to the atmosphere only through the first active carbon layer. When the engine is out of operation, requiring a large amount of fuel vapor to be stored, the fuel storage chamber is vented to the atmosphere through the first and second activated carbon layers. Therefore, when the engine is not operating, the ability of the canister to adsorb the fuel vapor is increased. A low-boiling-point component of the fuel vapor that passes through the first activated carbon layer is adsorbed by the second activated carbon layer, and hence is prevented from passing into the atmosphere. When the engine is in operation, since the fuel storage chamber is vented to the atmosphere only through the first activated carbon layer, the second activated carbon layer is not exposed to the fuel vapor, and is prevented from suffering aging.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
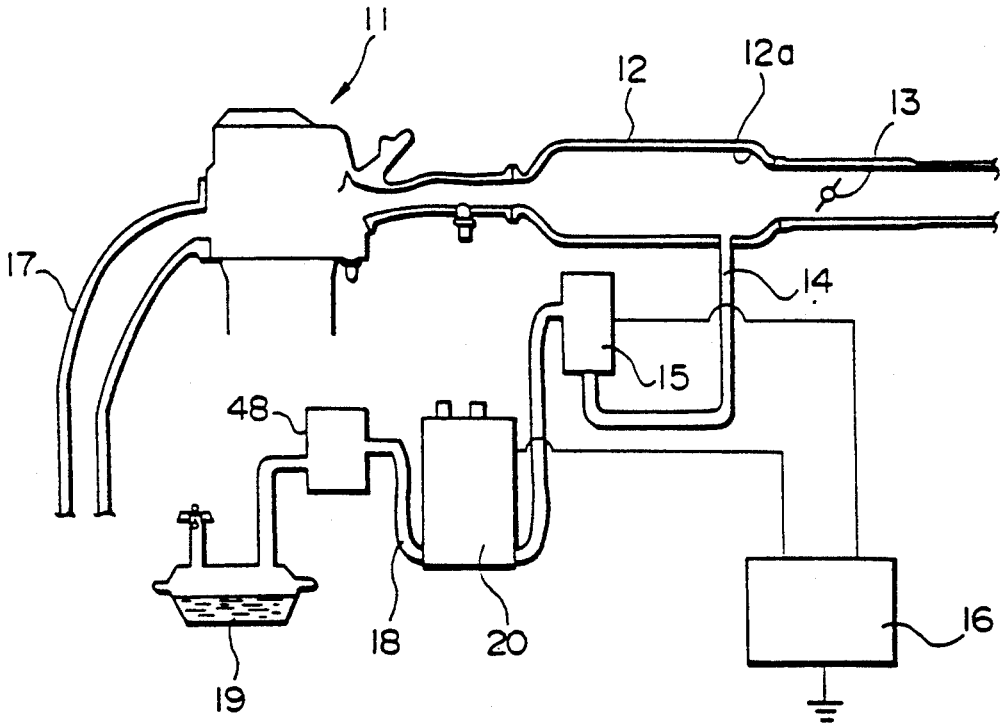
FIG. 1 is a diagram of a system for preventing fuel vapor from passing from an engine fuel supply system into the atmosphere, the system incorporating a fuel storage canister according to an embodiment of the present invention.

As shown in FIG. 1, a gasoline internal combustion engine 11 is associated with an engine fuel supply system including an intake pipe 12 that defines an intake passage 12*a* with a throttle valve 13 disposed therein. An exhaust pipe 17 is also connected to the engine 11.

A purge pipe 14 is connected to the intake pipe 12 downstream of the throttle valve 13. The purge pipe 14 is also connected to a fuel storage canister 20 through a purge control solenoid-operated valve 15 which controls a flow of fuel vapor through the purge pipe 14. The solenoid-operated valve 15 is electrically connected to a controller 16. When the engine 11 operates under a certain condition, i.e., when the engine 11 operates with a relatively high vacuum developed in the intake passage 12*a*, the solenoid-operated valve 15 is controlled by the controller 16 to open the purge pipe 14 into communication with the fuel storage canister 20.

To the fuel storage canister 20, there is also connected a charge pipe 18 that is connected to a fuel tank 19 through a two-way valve 48. The end of the charge pipe 18 which is connected to the fuel tank 19 opens into an upper space in the fuel tank 19 through a vapor separator (not shown).

Figure 2:
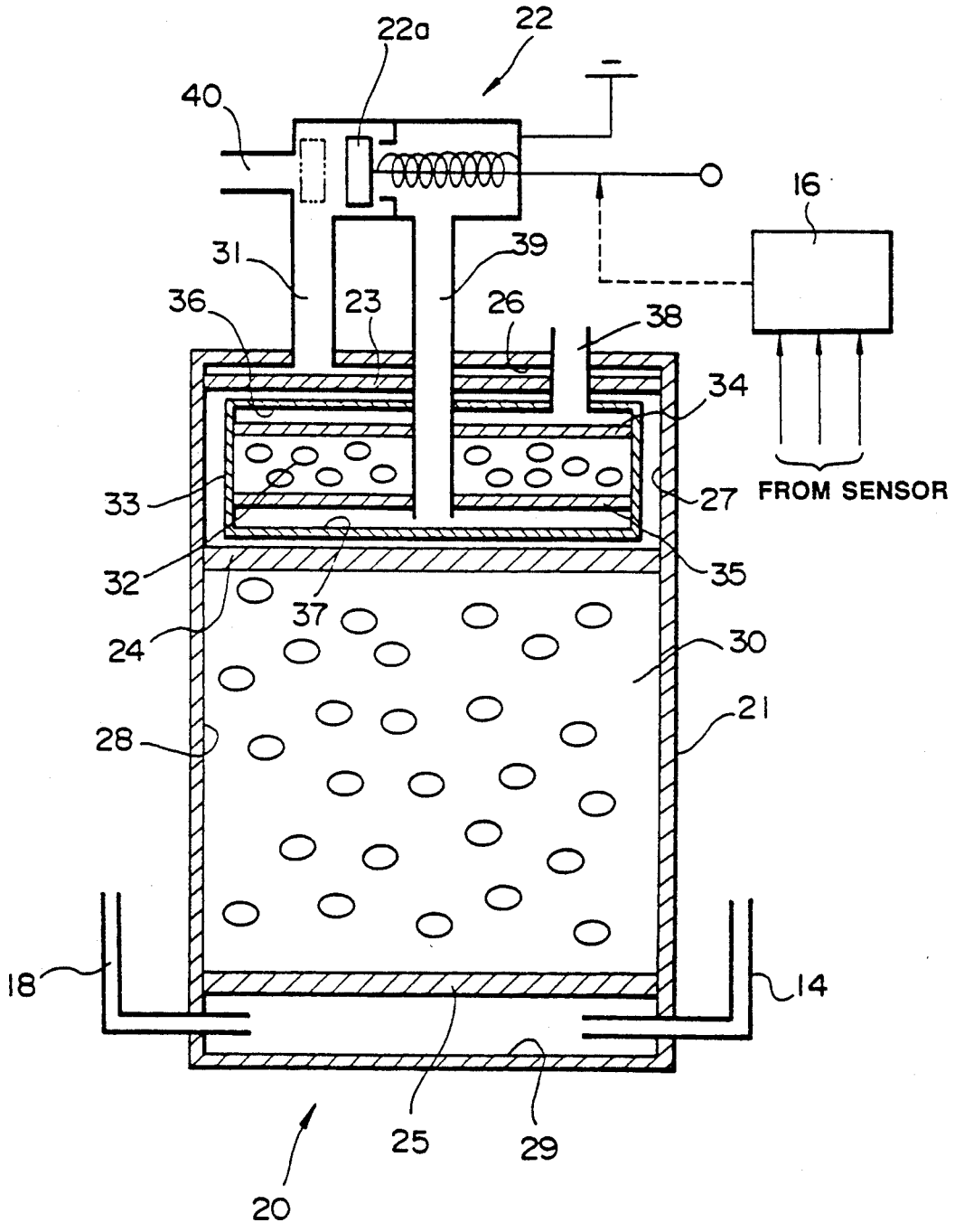
FIG. 2 is a cross-sectional view of the fuel storage canister.

As shown in FIG. 2, the fuel storage canister 20 has a hollow housing 21 with a directional control valve 22 mounted on the upper end of the housing 21. The housing 21 accommodates therein three vertically spaced screens 23, 24, 25 that vertically divide the interior space of the housing 21 into a drain chamber 26, a second adsorption chamber 27, a first adsorption chamber 28, and a fuel storage chamber 29. The screens 23, 24, 25 are made of a material capable of passing fuel vapor therethrough.

The purge pipe 14 and the charge pipe 18 open into the fuel storage chamber 29. The fuel storage chamber 29 is isolated at its upper end from the first adsorption chamber 28 by the screen 28 in fuel vapor transmitting relationship. A first communication passage 31 extends through an upper wall of the housing 21 and opens into the drain chamber 26, the first communication passage 31 being connected to the directional control valve 22. The drain chamber 26 is isolated at its lower end from the second adsorption chamber 27 by the screen 23 in fuel vapor transmitting relationship.

Figure 3:
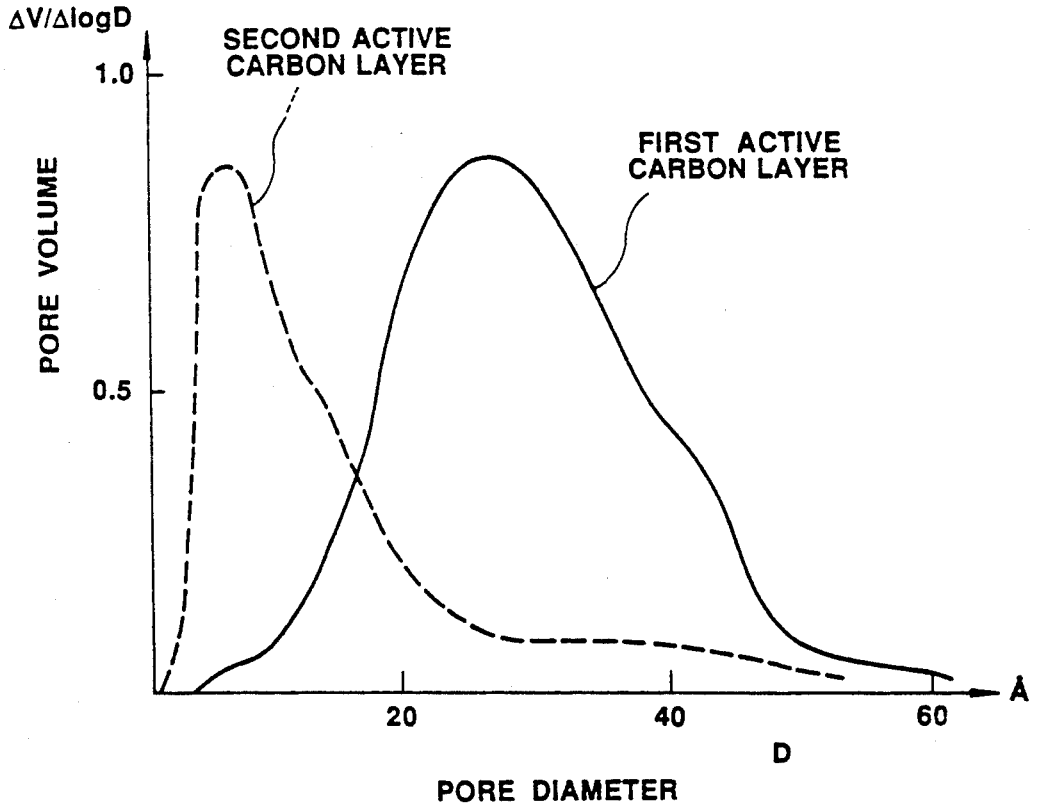
FIG. 3 is a graph showing pore characteristics of an active carbon layer in the fuel storage canister.

A first activated carbon layer 30 is disposed in the first adsorption chamber 28, and a second activated carbon layer 32 housed in a case 33 is disposed in the second adsorption chamber 27. The first activated carbon layer 30 is made up of an activated carbon with its pore diameter D and pore volume related to each other as indicated by the solid-line curve in FIG. 3, for better adsorption of hydrocarbons C3~C12 (a component of high boiling point). The second activated carbon layer 32 is made up of an activated carbon with its pore diameter D and pore volume related to each other as indicated by the broken-line curve in FIG. 3, for better adsorption of hydrocarbons C3, C4 (a component of low boiling point).

The case 33 is spaced a distance from the inner wall surface of the housing 21. The second activated carbon layer 32 is positioned between vertically spaced screens 34, 35 in the case 33. The screens 34, 35 define outlet and inlet chambers 36, 37 above and below the second activated carbon layer 32 within the case 33. A second venting passage 38 is open into the outlet chamber 36, and a second communication passage 39 is open into the inlet chamber 37. The second venting passage 38 extends through the upper wall of the housing 21 and is vented to the atmosphere. The second communication passage 39 is connected to the directional control valve 22.

The directional control valve 22 comprises a three-port two-position solenoid-operated valve. The ports of the directional control valve 22 are connected to a first venting passage 40 that is vented to the atmosphere, the first communication passage 31, and the second communication passage 39. The directional control valve 22 has a solenoid electrically connected to the controller 16 for magnetically moving a valve body **22*a*. When the solenoid is not energized, the valve body 22*a* is in a broken-line position, closing the first venting passage 40 and allowing communication between the first communication passage 31 and the second communication passage 39. When the solenoid is energized, the valve body 22*a* is shifted into a solid-line position, opening the first venting passage 40 into communication with the first communication passage 31 and closing the second communication passage 39**.

To the controller 16, there are electrically connected various sensors for detecting operating conditions of the engine 11, e.g., a rotation sensor for detecting the rotational speed of the crankshaft of the engine 11, and a vacuum sensor for detecting the vacuum developed in the intake passage **12*a*. The controller 16 comprises an ECU or the like for processing output signals from the sensors, energizing the solenoid of the directional control valve 22 when the engine 11 is in operation, and energizing the solenoid of the solenoid-operated valve 15 when the vacuum in the intake passage 12*a*** is high.

The operating conditions of the engine 11 are detected by the sensors, as described above. When the engine is in operation as detected by the sensors, the controller 16 energizes the solenoid of the directional control valve 22, which closes the second communication passage 39 and provides communication between the first venting passage 40 and the first communication passage 31. Therefore, fuel vapor flowing from the fuel tank 19 into the fuel storage chamber 29 flows upwardly through and is adsorbed by the first activated carbon layer 30, and is not discharged into the atmosphere. The fuel vapor is not adsorbed by the second activated carbon layer 32, and the adsorbing capability of the second activated carbon layer 32 is not affected.

During operation of the engine 11, a large amount of high-boiling-point component of the fuel vapor is evaporated from the fuel in the fuel storage chamber 29. Since the first activated carbon layer 30 is capable of adsorbing the high-boiling-point component of the fuel highly efficiently, it can effectively adsorb the high-boiling-point component.

As is well known in the art, the fuel is purged from the fuel storage canister 20 into the intake passage **12*a* when the vacuum developed in the intake passage 12*a* is increased while the engine 11 is in operation. More specifically, when the vacuum in the intake passage 12*a* is increased, the solenoid-operated valve 15 is opened by the controller 1. Atmospheric air then flows from the first venting passage 40 into the housing 21, forcing the fuel adsorbed by the first activated carbon layer 30 and the fuel in the fuel storage chamber 29 into the intake passage 12*a* through the purge pipe 14**.

When the engine 11 is not in operation as detected by the sensors, the controller 16 de-energizes the solenoid of the directional control valve 22, which then closes the first venting passage 40 and provides communication between the first and second communication passages 31, 39. Therefore, the fuel storage chamber 29 is vented to the atmosphere through the first and second activated carbon layers 30, 32. The fuel vapor flows upwardly through and is therefore adsorbed by the activated carbon layers 30, 32, and is prevented from passing into the atmosphere.

The second activated carbon layer 32 maintains a sufficient adsorption capability as no fuel has been adsorbed thereto when the engine 11 is in operation, as described above. In addition, the second activated carbon layer 32 is capable of efficiently adsorbing a low-boiling-point component of the fuel vapor. Therefore, even when the engine 11 remains out of operation for a long period of time, the low-boiling-point component of the fuel vapor that has passed through the first activated carbon layer 30 is reliably adsorbed by the second activated carbon layer 32 without fail.

Figure 4:
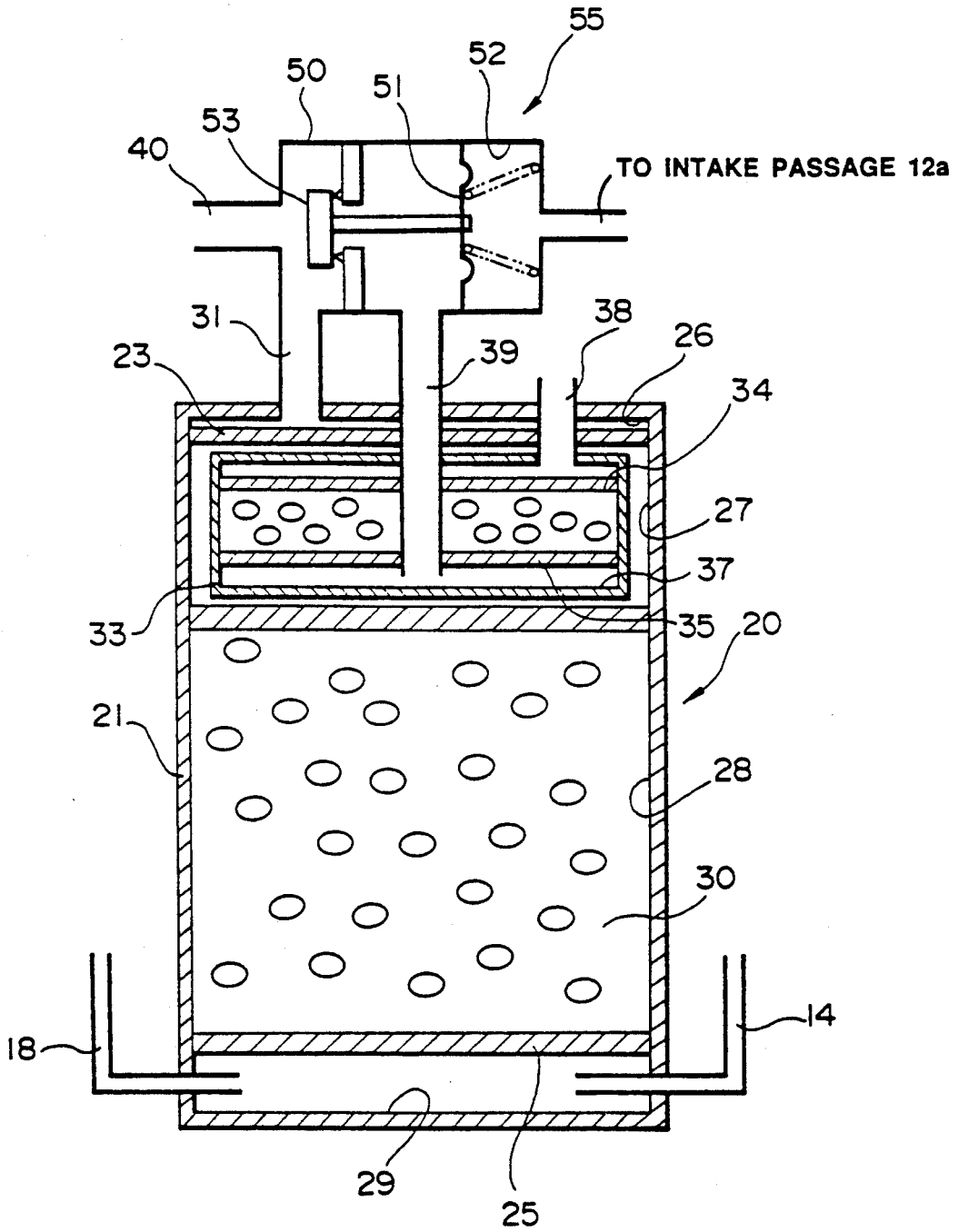
FIG. 4 is a cross-sectional view of a fuel storage canister according to another embodiment of the present invention.

FIG. 4 shows a fuel storage canister according to another embodiment of the present invention. Those parts show in FIG. 4 which are identical to those shown in FIG. 2 are denoted by identical reference numerals, and will not be described in detail below.

A directional control valve 55 connected to the fuel storage canister 20 through the first and second communication passages 31, 39 comprises a valve actuatable by a vacuum developed in the intake passage 12*a*. The directional control valve 55 comprises a housing 50 accommodating a flexible diaphragm 51 which defines a vacuum chamber 52 in the housing 50. The vacuum chamber 52 communicates with the intake passage 12*a* downstream of the throttle valve 13 (see FIG. 1). The flexible diaphragm 51 is connected to a valve body 53. The flexible diaphragm 51 flexes under the vacuum developed in the intake passage 12*a* to displace the valve body 53 selectively into a position in which the first venting passage 40 communicates with the first communication passage 31 and a position in which the first communication passage 31 communicates with the second communication passage 39.

Specifically, when the engine 11 is in operation, the valve body 53 is in the illustrated position under the vacuum developed in the intake passage 12*a*, providing communication between the first venting passage 40 and the first communication passage 31. When the engine 11 is out of operation, the valve body 53 is displaced to the left (as viewed in FIG. 4), closing the first venting passage 40 and providing communication between the first and second communication passages 31, 39.

In the embodiment shown in FIG. 4, since the directional control valve 55 operates in response to the vacuum developed in the intake passage 12*a*, no sensors and no controller are required to control the operation of the directional control valve 55.

In the illustrated embodiments, the directional control valve 22, 55 is actuated depending on whether the engine is in operation or out of operation. However, the directional control valve 22, 55 may be controlled depending on a certain engine operating parameter such as the speed of rotation of the engine 11 or the like.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

We claim:

1. A fuel storage canister for use with an engine and a fuel tank, comprising:

a housing;

a fuel storage chamber defined in said housing and adapted to be connected to the fuel tank;

a first activated carbon layer disposed in said housing for adsorbing fuel vapor;

first passage means connected to said housing for venting said fuel storage chamber through said first activated carbon layer to the atmosphere;

a second activated carbon layer disposed in said housing for adsorbing fuel vapor;

second passage means connected to said housing for venting said fuel storage chamber through said first and second activated carbon layers to the atmosphere; and valve means connected to said first and second passage means for selectively opening said first and second passage means depending on an operating condition of the engine.

2. A fuel storage canister according to claim 1, wherein said valve means comprises means for opening said first passage means when the engine is in operation and for opening said second passage means when the engine is out of operation.

3. A fuel storage canister according to claim 1, wherein said first and second passage means are arranged to direct a flow of fuel vapor upwardly through both of said first and second activated carbon layers when the engine is not in operation.

4. A fuel storage canister according to claim 1, wherein said first activated carbon layer is positioned above said fuel storage chamber and said second activated carbon layer is positioned above said first activated carbon layer.

5. A fuel storage canister according to claim 1, further including control means for controlling said valve means to selectively open said first and second passage means depending on the operating condition of the engine.

6. A fuel storage canister according to claim 5, wherein said control means comprises a sensor for detecting the operating condition of the engine and producing an output signal indicative of the operating condition of the engine, and a controller responsive to the output signal from said sensor for controlling said valve means.

7. A fuel storage canister according to claim 1, wherein said valve means comprises means responsive to a vacuum developed in the engine for controlling said valve means.

8. A fuel storage canister according to claim 1, further comprising a fuel purging means capable of connecting said fuel storage canister to an engine fuel supply system of the engine for purging the fuel adsorbed in said fuel storage canister into said engine fuel supply system depending on an operating condition of the engine.

9. A fuel storage canister for use with an engine and a fuel tank, comprising:

a housing;

a fuel storage chamber defined in said housing and adapted to be connected to the fuel tank;

a first activated carbon layer disposed in said housing for adsorbing fuel vapor;

a first communication passage connected to said housing;

a first venting passage for venting said first activated carbon layer through said first communication passage to the atmosphere;

a second activated carbon layer disposed in said housing for adsorbing fuel vapor;

a second communication passage connected to said housing;

a second venting passage connected to said housing for venting said first and second activated carbon layers through said second communication passage to the atmosphere; and valve means connected to said first and second communication passage means for connecting said first venting passage and said first communication passage and closing said second communication passage or closing said first venting passage and connecting said first and second communication passages depending on an operating condition of the engine.

10. A fuel storage canister according to claim 9, wherein said valve means comprises means for connecting said first venting passage and said first communication passage and opening said first venting passage when the engine is in operation and for closing said first venting passage and connecting said first and second communication passages when the engine is not in operation.

11. A fuel storage canister according to claim 9, further comprising a fuel purging means capable of connect said fuel storage canister to an engine fuel supply system of the engine for purging the fuel adsorbed in said fuel storage canister into said engine fuel supply system depending on an operating condition of the engine.

* * * * *